United States Patent [19]

Griffiths et al.

[11] 4,320,309

[45] Mar. 16, 1982

[54] OSCILLATORY CIRCUIT UTILIZING PTC RESISTOR

[75] Inventors: Charles R. Griffiths, Standish; William G. Ferguson, Cumberland Center, both of Me.

[73] Assignee: GTE Products Corporation, Stamford, Conn.

[21] Appl. No.: 108,616

[22] Filed: Dec. 31, 1979

[51] Int. Cl.[3] ..... H01H 61/06

[52] U.S. Cl. ..... 307/132 T; 361/165; 307/96

[58] Field of Search ..... 307/132 R, 132 E, 132 EA, 307/132 T, 132 V, 132 M, 96; 361/165, 161, 195; 335/87

[56] References Cited

U.S. PATENT DOCUMENTS 2,482,820 9/1949 Wolfson et al. ..... 361/165 X

*Primary Examiner*—Michael L. Gellner
*Assistant Examiner*—James L. Dwyer
*Attorney, Agent, or Firm*—James Theodosopoulos

[57] ABSTRACT

A control circuit for producing a repetitive closed-circuit, open-circuit condition between an electrical power source, such as a battery, and an electrical load comprises a positive temperature coefficient resistor in series with a relay coil. The PTC resistor is caused to alternate between a low resistance state and a high resistance state which permits energization and de-energization of the relay coil.

1 Claim, 6 Drawing Figures

OSCILLATORY CIRCUIT UTILIZING PTC RESISTOR

DESCRIPTION

TECHNICAL FIELD

This invention is concerned with the use of a positive temperature coefficient resistor (hereafter referred to as PTCR) in an electrical circuit to produce a repetitive closed-circuit, open-circuit condition.

DISCLOSURE OF INVENTION

A circuit in accordance with this invention comprises a PTCR in series with a relay coil. The relay coil, when energized, places a load in the circuit and, when de-energized, removes the load from the circuit. The characteristics of the PTCR and relay coil are such that the circuit oscillates between the load energized and load de-energized conditions as long as power is applied to the circuit.

DESCRIPTION OF PREFERRED EMBODIMENT

Figure 1:
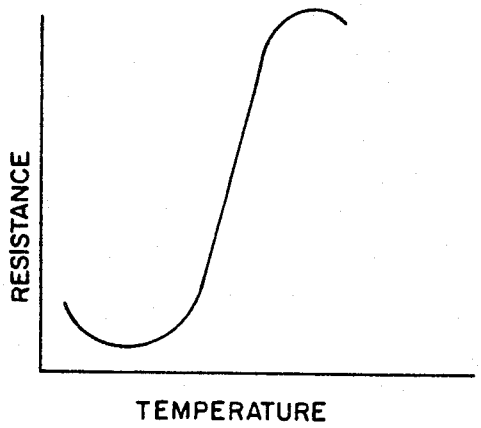
FIG. 1 shows the resistance versus temperature curve of a PTCR used in the circuit of this invention.

A PTCR for use with this invention has a resistance-temperature characteristic as shown in FIG. 1 and can be of the barium titanate type doped with lanthanum, niobium, yttrium or the like. The anomaly or switch temperature of the composition may be varied chemically by means known in the art.

Figure 2:
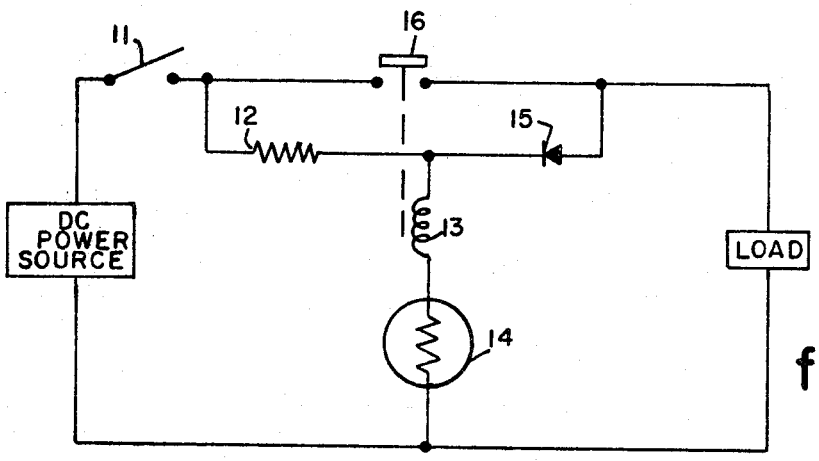
FIG. 2 shows a circuit in accordance with this invention.
Figure 3:
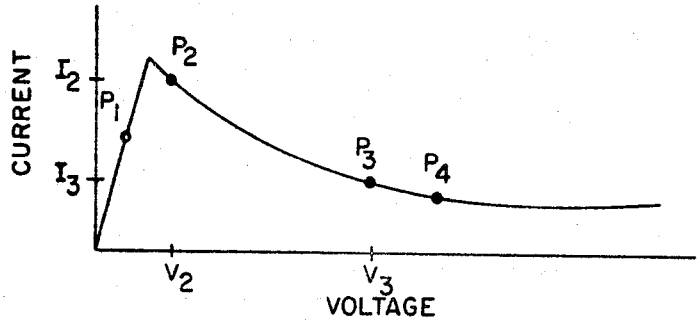
FIG. 3 shows current versus voltage.
Figure 4:
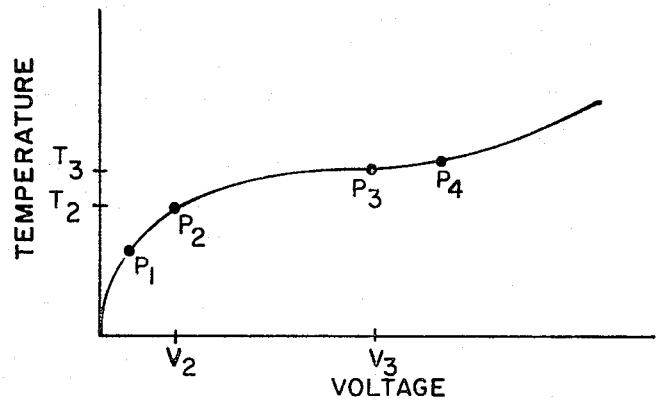
FIG. 4 shows temperature versus voltage for the PTCR.

A control circuit for a DC power source is shown in FIG. 2. Closure of switch 11 produces direct current flow through the series combination of resistor 12, relay coil 13 and PTCR 14. No current flows through the load due to the blocking action of diode 15. The circuit resistance under this condition is such that sufficient current flows through relay coil 13 to produce energization and closure of relay contacts 16. Closure of contacts 16 permits current to flow through the load and also places a short circuit across resistor 12 through diode 15. The stable operating point of PTCR 14 under this condition is the high-resistance, high-voltage, low-current point $P_4$ of FIG. 3. As indicated in FIG. 4, $P_4$ is also a high temperature state of PTCR 14. As PTCR 14 heats toward operating point $P_4$, the current through PTCR 14 and relay coil 13 increases to a maximum initially and then continually decreases, following the curve of FIG. 3. Before operating point $P_4$ is achieved, the decreasing current through relay 13 drops to the relay de-energization point, point $P_3$, at which time relay contacts 16 open, stopping current flow to the load and reinserting resistor 12 into the circuit. The stable operating point of PTCR 14 under this condition is low-resistance, low-voltage, high-current point $P_1$ of FIG. 3. As can be seen from FIG. 4, $P_1$ is a lower temperature state of PTCR 14 than is $P_4$ or $P_3$. The PTCR thus cools causing the current through it, relay coil 13 and resistor 12 to increase. Before operating point $P_1$ is achieved, the increasing current through relay coil 13 reaches the relay energization point, point $P_2$, at which time relay contacts 16 close, permitting current to flow through the load and also placing a short circuit across resistor 12 through diode 15. The stable operating point of the PTCR now becomes $P_4$ again. The PTCR heats up, decreasing the current through relay 13 until de-energization point $P_3$ is achieved, opening relay contacts 16, which stops current flow to the load and reinserts resistor 12 into the circuit. The oscillatory action of the current between points $P_3$ and $P_2$ continues until switch 11 is opened. After an initial cycle, when PTCR 14 has to warm up from a low ambient temperature, the oscillation period produced by this control circuit occurs between temperatures $T_2$ and $T_3$ shown in FIG. 4. Electrical power is applied to the load during the time interval that PTCR 14 is heating from temperature $T_2$ to $T_3$, and electrical power is off the load during the time interval that PTCR 14 is cooling from temperature $T_3$ to $T_2$. The oscillation period is goverened by the energization and de-energization current values of relay 13, the heat capacity of PTCR 14, the current-voltage and temperature-voltage characteristics of PTCR 14 and the thermal environment of PTCR 14.

Figure 5:
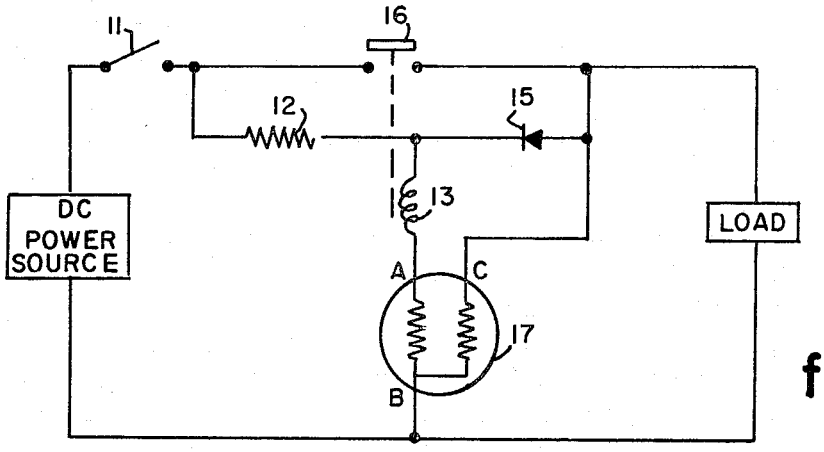
FIGS. 5 and 6 show other circuits in accordance with this invention.

The on-time of the circuit of FIG. 2 may be decreased by modifying it to the circuit shown in FIG. 5 in which PTCR 17 is a multiple electrode device. An example of such a multiply electroded PTCR is shown in U.S. Pat. No. 4,131,657. Section BC of PTCR 17 is directly across the DC power source when relay contacts 16 are closed. The resistance of section BC is such that $I^2R$ heating of this section is greater than that of section AB. Thus, section BC will heat more rapidly than section AB. Thermal transfer through the PTCR material from BC to AB will augment the $I^2R$ heating of section AB, increasing its heating rate over what it would be if the PTCR were not multiply electroded. Since section BC is unenergized when relay contacts 16 are open, the cooling of section AB proceeds as described above for the circuit of FIG. 2.

Figure 6:
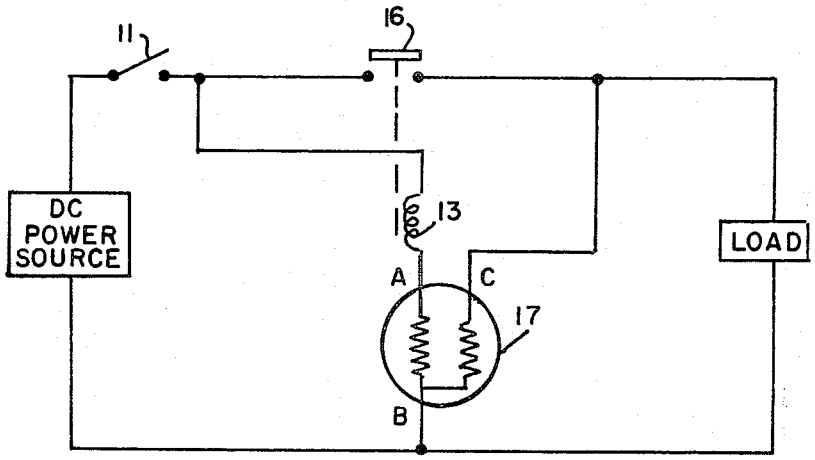

Both the above circuits are designed to function with a direct current power source. The circuit in FIG. 6 may be used with either a direct current or alternating current power source. Multiple electrode PTCR 17 is designed such that with only section AB energized, the stable operating point is point $P_1$ of FIGS. 3 and 4, and the stable operating point with section BC and AB energized is point $P_4$ of the same figures. The oscillatory operation between points $P_2$ and $P_3$ proceeds as described previously.

The circuit of FIG. 5 was used in an application involving the starting of diesel engines. In such engines it is necessary to raise the temperature of the engine fuel combustion chamber to some minimum value. This is accomplished through the use of electrical heaters called glow plugs. The length of time that power is applied to the glow plugs must be precisely controlled in order to prevent overheating. Also, the chamber temperature must be maintained until the engine starts. These objectives were accomplished with the circuit of FIG. 5 according to a precise on-off schedule which varies with engine ambient temperature. The DC power source was 12 volts. The value of resistor 12 was 12 ohms. Section AB of PTCR 17 had an initial resistance of 10 ohms and section BC had an initial resistance of 1.8 ohms. The anomaly temperature of PTCR 17 was 100° C. Relay coil 13 had a resistance of 30 ohms, a minimum energization current of 133 milliamperes and a de-energization current of 67 milliamperes. The oscillation period of the circuit was 0.8 seconds on (power applied to the glow plugs), and 4 seconds off. When the engine started, switch 11 opened.

We claim:

1. A control circuit for applying power to a load in accordance with a predetermined on-off cycle comprising: a power source; a switch in series with the power source; the combination of a resistor, a relay coil and a PTC resistor forming a first series circuit between the switch and the power source; the combination of a pair of contacts and a load forming a second series circuit between the switch and the power source, the second series circuit being in parallel to the first series circuit, the pair of contacts being energizable by the relay coil; and a diode electrically connected at one end to a point between the resistor and the relay coil and at the end to a point between the pair of contacts and the load.

* * * * *